US007497549B2

(12) United States Patent
Zhou

(10) Patent No.: US 7,497,549 B2
(45) Date of Patent: Mar. 3, 2009

(54) PRINTER WITH CAP MECHANISM

(75) Inventor: Peng Zhou, Jiangsu (CN)

(73) Assignee: Qisda Corporation, Taoyuan County (TW)

( * ) Notice: Subject to any disclaimer, the term of this patent is extended or adjusted under 35 U.S.C. 154(b) by 415 days.

(21) Appl. No.: 11/400,213

(22) Filed: Apr. 10, 2006

(65) Prior Publication Data

US 2006/0232617 A1 Oct. 19, 2006

(30) Foreign Application Priority Data

Apr. 18, 2005 (TW) ..... 94112232 A

(51) Int. Cl.
*B41J 2/165* (2006.01)

(52) U.S. Cl. ..... 347/29; 347/32

(58) Field of Classification Search ..... 347/29, 347/30, 32, 33

See application file for complete search history.

(56) References Cited

U.S. PATENT DOCUMENTS 5,663,751 A * 9/1997 Holbrook ..... 347/22
5,677,715 A * 10/1997 Beck ..... 347/29
6,830,311 B2 * 12/2004 Fukasawa et al. ..... 347/29
7,322,670 B2 * 1/2008 Hayashi ..... 347/32

FOREIGN PATENT DOCUMENTS

JP 359055757 A * 3/1984 ..... 347/29
JP 360224550 A * 11/1985 ..... 347/32
JP 406055730 A * 3/1994 ..... 347/29

* cited by examiner

*Primary Examiner*—Shih-Wen Hsieh

(57) ABSTRACT

A printer with a cap mechanism. The printer comprises a print head comprising a nozzle, a cap module comprising a cap and a hole, and a positioning module comprising a pin. When the print head moves in a first direction to push the positioning module, the pin escapes from the hole, whereby the cap module moving in a second direction enables the cap to cover the nozzle. When the print head moves in a direction opposite to the first direction, the pin enters the hole enabling the cap module to maintain a predetermined distance from the print head.

12 Claims, 10 Drawing Sheets

PRINTER WITH CAP MECHANISM

BACKGROUND OF THE INVENTION

1. Field of the Invention

The invention relates to a printer, and in particular to a printer with a cap only covering the nozzle of the print head when the print head is positioned.

2. Brief Discussion of the Related Art

A conventional print head moves in a service station for maintenance. A wiper scrapes the residual ink from the nozzle and a cap moves to cover the nozzle. In such a structure, when the cap is moved to cover the nozzle, the print head is not yet positioned. Thus, the print head interferes with the cap, resulting in a poor seal between the cap and the nozzle, and potentially damaging the cap.

SUMMARY OF THE INVENTION

An embodiment of a printer comprises a print head comprising the nozzle, a cap module comprising a cap and a hole, and a positioning module comprising a pin. When the print head moves in a first direction to push the positioning module, the pin escapes from the hole, whereby the cap module moves in a second direction enabling the cap to cover the nozzle. When the print head moves in a direction opposite to the first direction, the pin enters the hole enabling the cap module to maintain a predetermined distance from the print head. The first direction is perpendicular to the second direction The print head further comprises a first guide member, and the cap module further comprises a second guide member. When the print head moves in the direction opposite to the first direction, the first guide member pushes the second guide member, thereby the pin entering the hole.

The first guide member has a first incline, and the second guide member has a second incline. The first incline contacts the second incline when the first guide member pushes the second guide member.

The embodiment of a printer further comprises a first bias member biasing the cap module to move the cap module toward the print head and enabling the cap to cover the nozzle, and When the print head moves in the direction opposite to the first direction, it pushes the cap module to resist the bias force of the first bias member.

The printer further comprises a second bias member biasing the positioning module. When the print head moves in the direction opposite to the first direction, the second bias member biases the positioning module, thereby the pin entering the hole.

The hole comprises a first portion and a second portion having a diameter smaller than that of the first portion. The pin, entering the hole, passes through the first portion and the second portion sequentially.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE PREFERRED EMBODIMENTS

Figure 1:
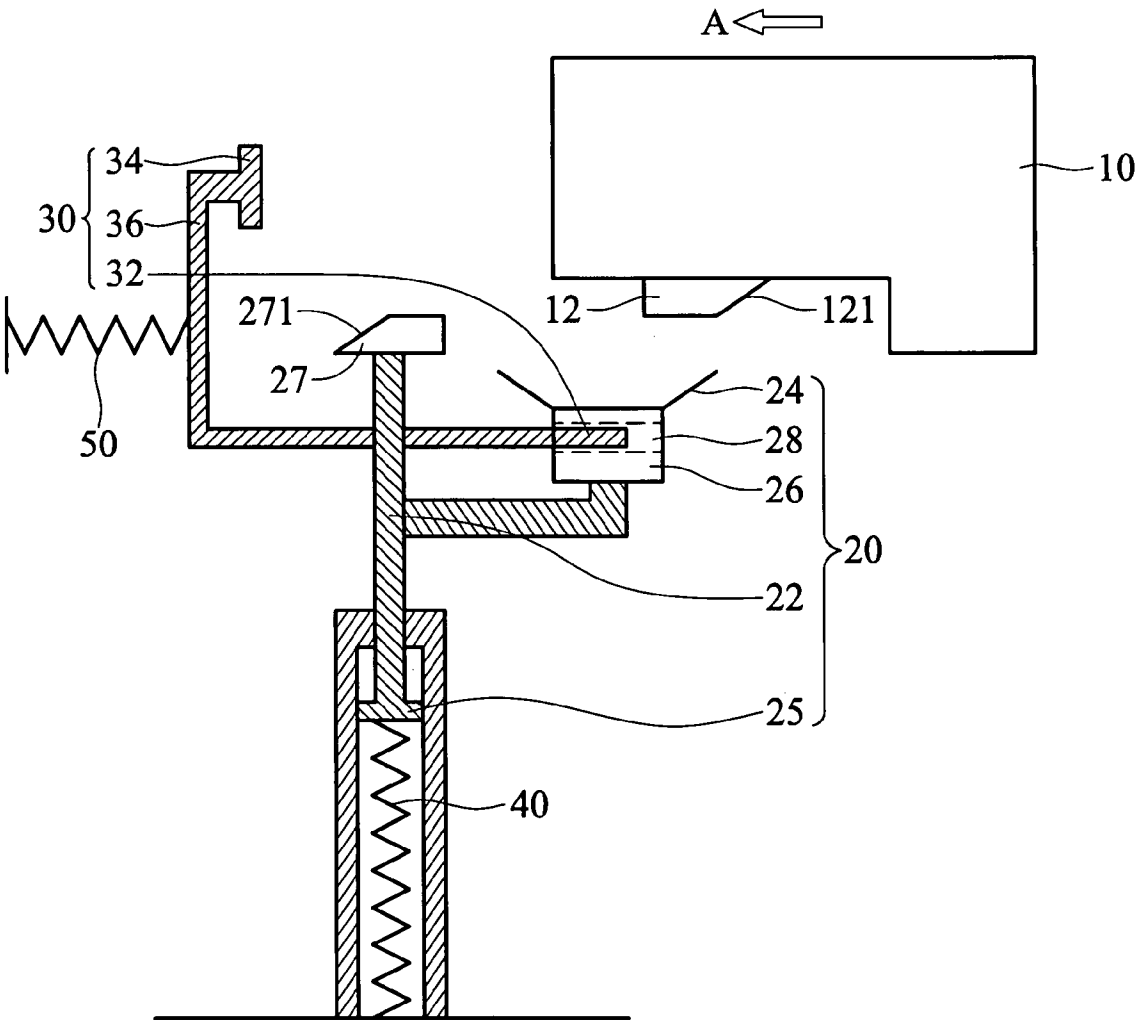
FIG. 1 is a schematic view of an embodiment of a printer with a print head and cap mechanism of the invention.
Figure 3:
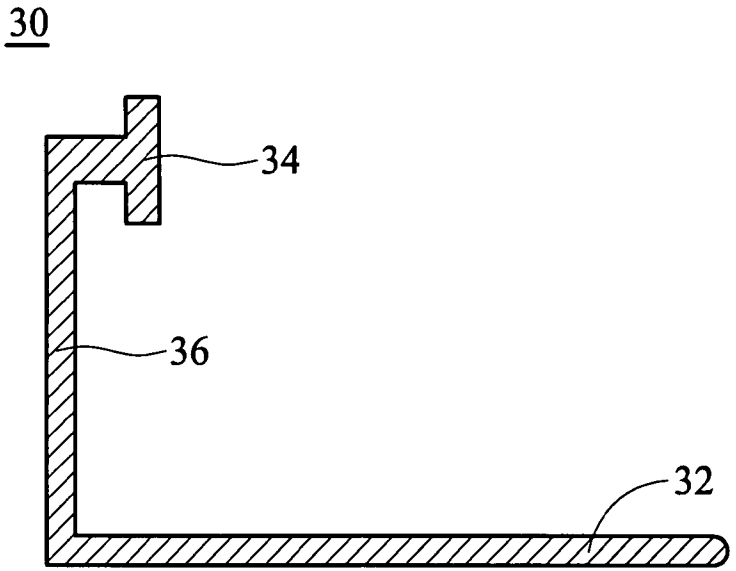
FIG. 3 is a schematic view of an embodiment of a positioning module of the invention.
Figure 2:
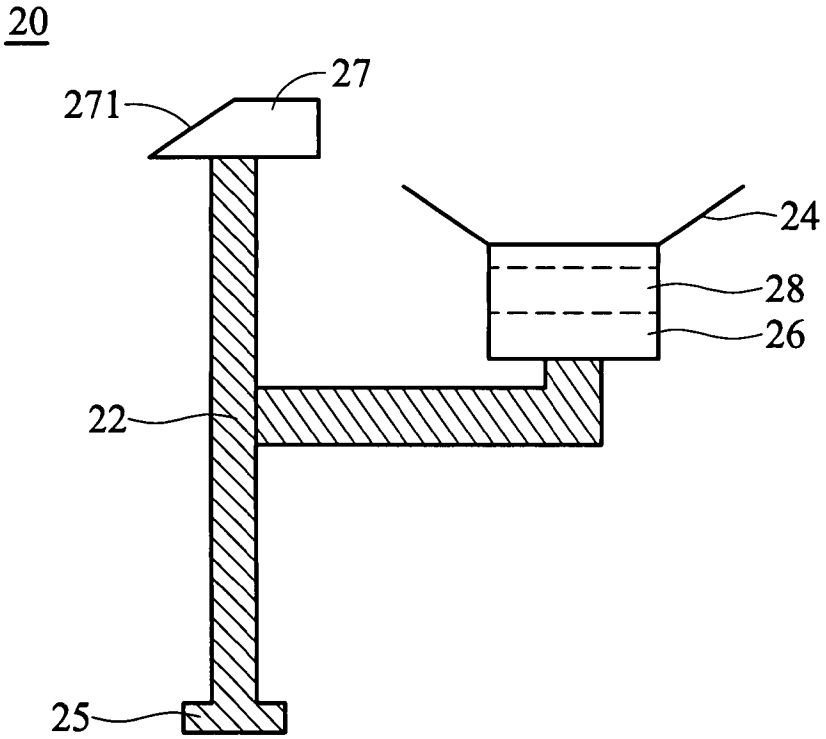
FIG. 2 is a schematic view of an embodiment of a cap module of the invention.

Referring to FIG. 1, an embodiment of a printer of the invention comprises a print head 10, a cap module 20, a positioning module 30, a first bias member 40 and a second bias member 50. The print head 10 comprises a first guide member 12. The cap module 20 comprises a main body 22, a cap 24, a bias portion 25, a cap seat 26, a second guide member 27 and a hole 28. The positioning module 30 comprises a pin 32, a bump plate 34 and a connecting portion 36. In this embodiment, the first and second bias member 40 and 50 are compression springs, wherein the first bias member 40 biases the bias portion 25, and the second bias member 50 biases the connecting portion 36. Referring to FIG. 2, in the cap module 20, the cap 24 is mounted on the cap seat 26 disposed on the main body 22. The second guide member 27 is also disposed on the main body 22. Referring to FIG. 3, in the positioning module 30, the connecting portion 36 connects the bump plate 34 and the pin 32, which comprises an end with fillets, to prevent friction from occurring between the pin 32 and the lateral wall of the cap seat 26. In this embodiment, the first guide member 12 and the second guide member 27 are two wedges with similar shapes and having a first incline 121 and a second incline 271 respectively. The pin 32 enters the hole 28 to position the cap 24 and maintain a predetermined distance with the print head 10.

Figure 4:
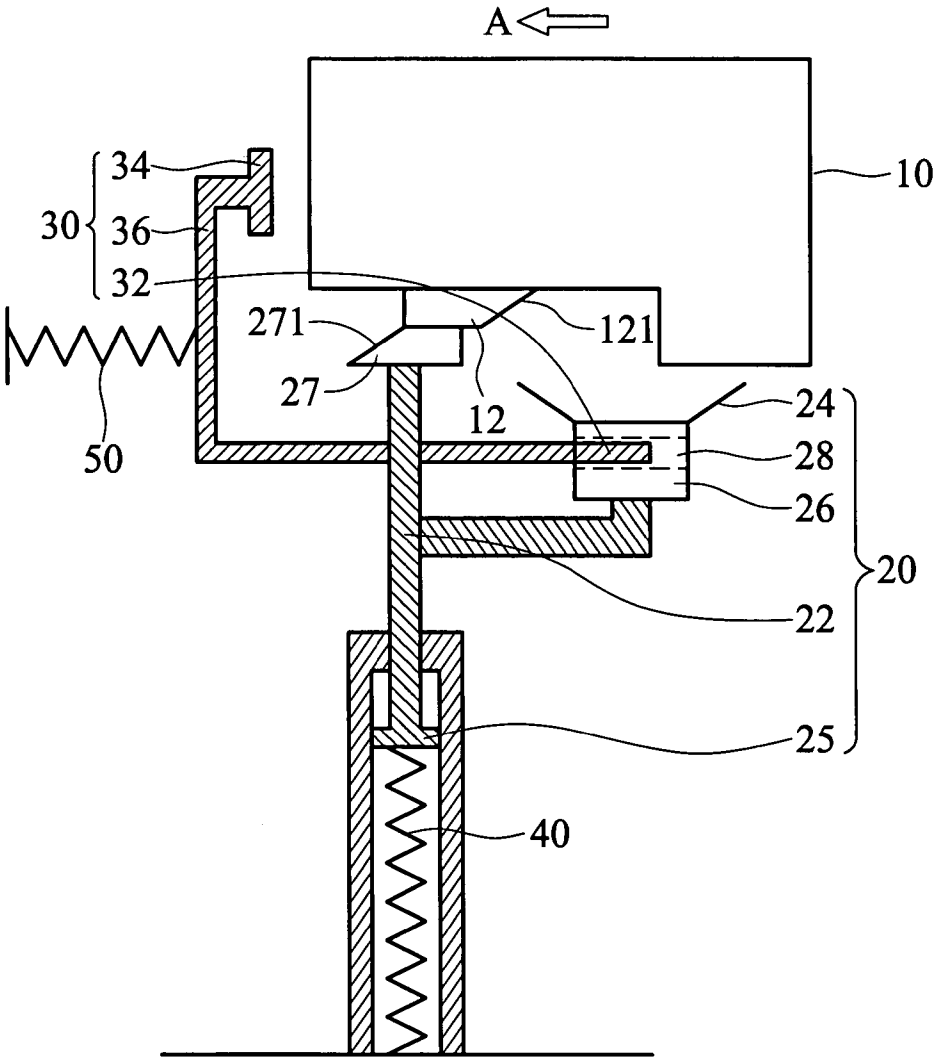
FIGS. 4 to 9 depict motion of the print head and the cap module of the invention.
Figure 5:
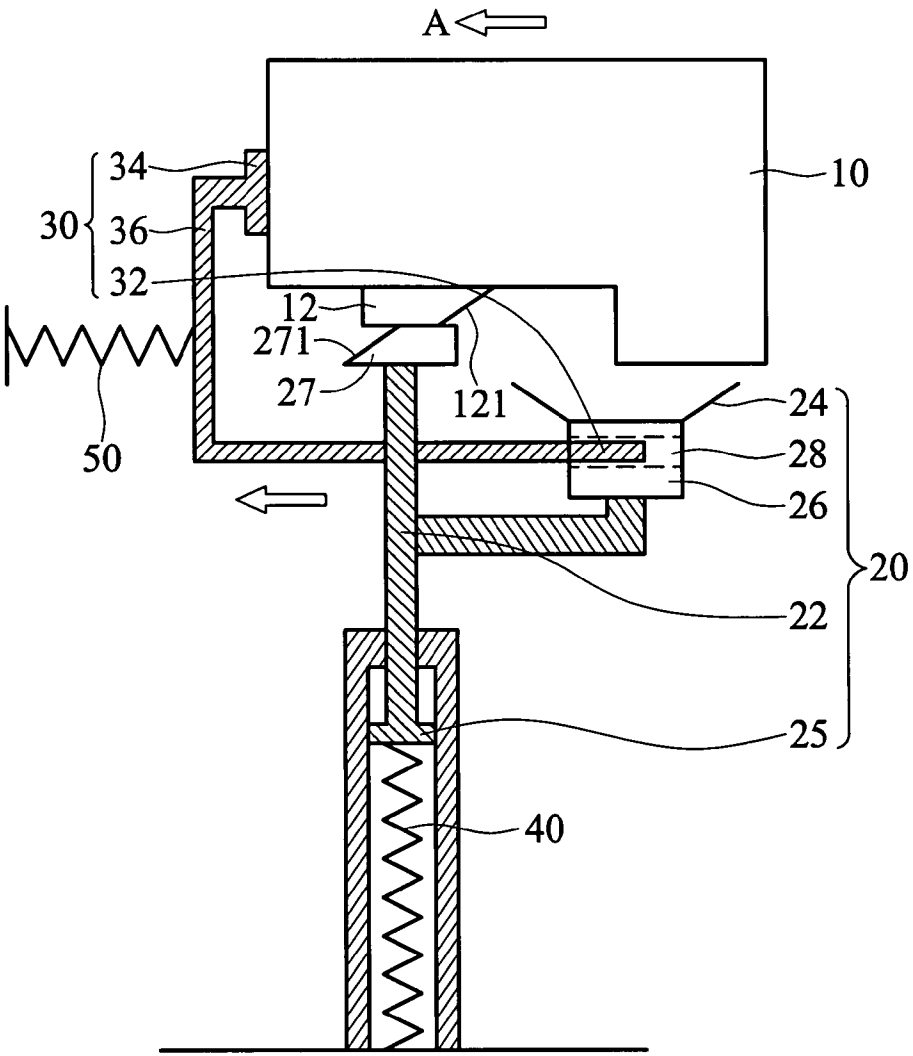
Figure 6:
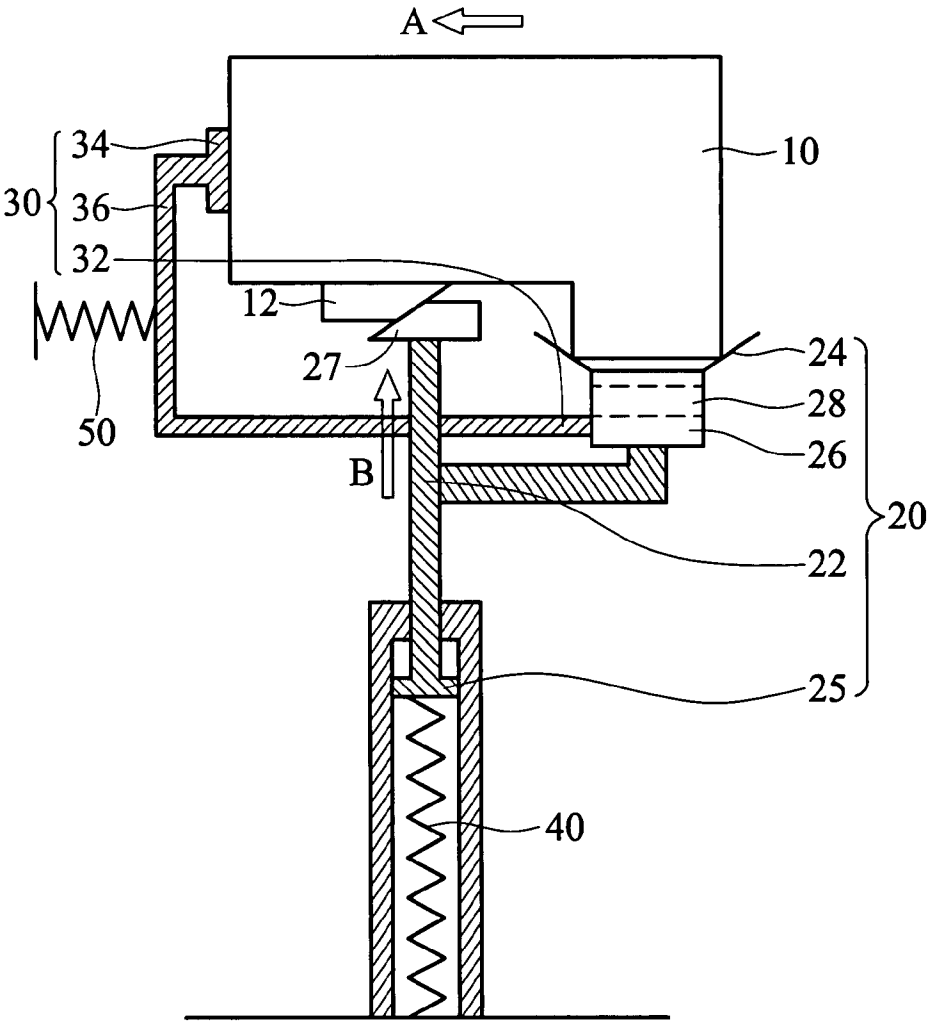

FIGS. 4 to 9 depict the motion of the print head 10 and the cap module 20. The print head 10 moves in a direction shown by an arrow A (a first direction) and pushes the bump plate 34 of the positioning module 30, thereby the pin 32 moves leftward, at which time the pin 32 escapes from the hole 28 as shown in FIGS. 4 and 5. When the print head 10 is positioned, the pin 32 separates from the hole 28 completely, and the cap 20 is pushed by the first bias member 40 to move in a direction shown by an arrow B (a second direction) and cover the nozzle (not shown) of the print head 10. At this time, the first incline 121 of the first guide member 12 contacts the second incline 271 of the second guide member 27. The pin 32 is biased by the second bias member 50 to abut the lateral wall of the cap seat 26 as shown in FIG. 6.

Figure 7:
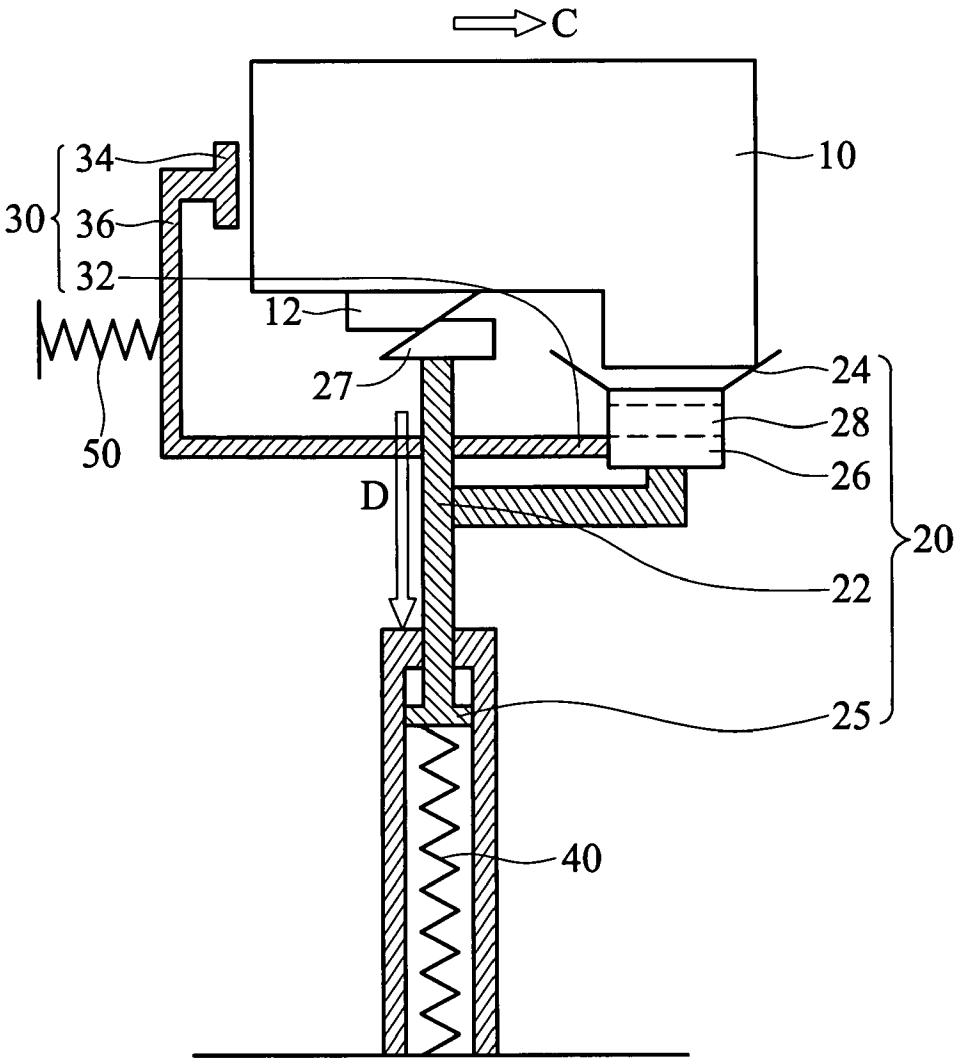
Figure 8:
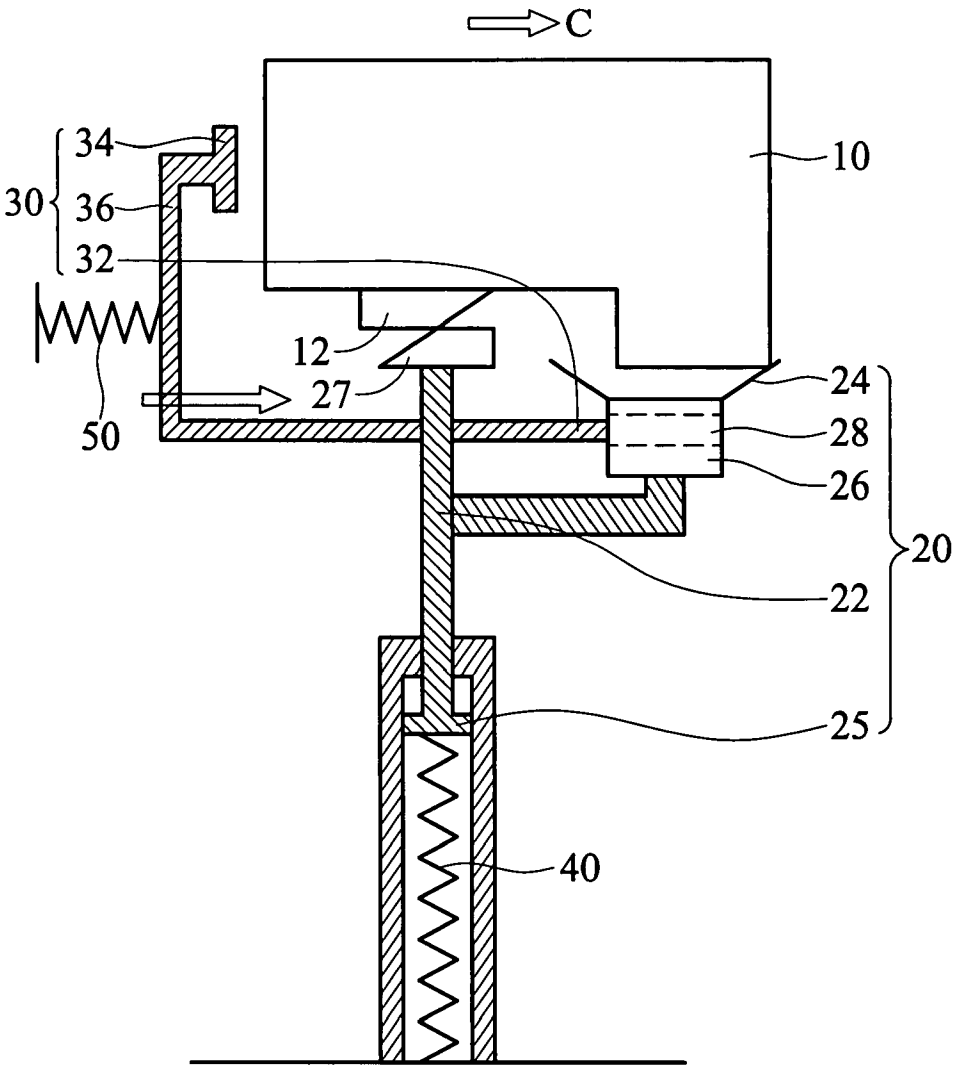
Figure 9:
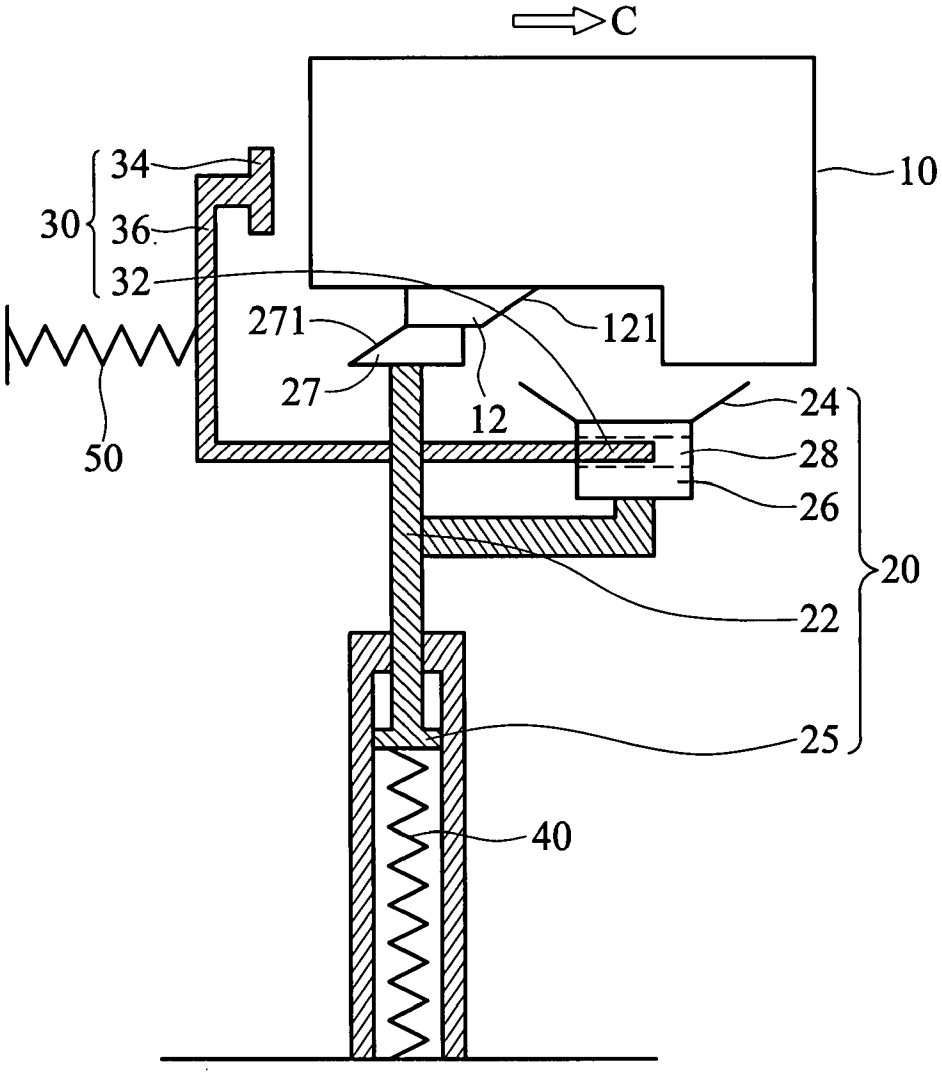

When the print head 10 moves in a direction shown by an arrow C (the direction opposite to the first direction), the first incline 121 moves relative to the second incline 271, thereby the cap module 20 moves in the direction shown by an arrow D as shown in FIG. 7. The cap module 20 moves until the pin 32 is aligned with the hole 28 as shown in FIG. 8. The pin 32 is pushed by the second bias member 50 to enter the hole 28, whereby the cap module 20 is positioned and maintains a predetermined distance with the print head 10 as shown in FIG. 9.

Figure 10:
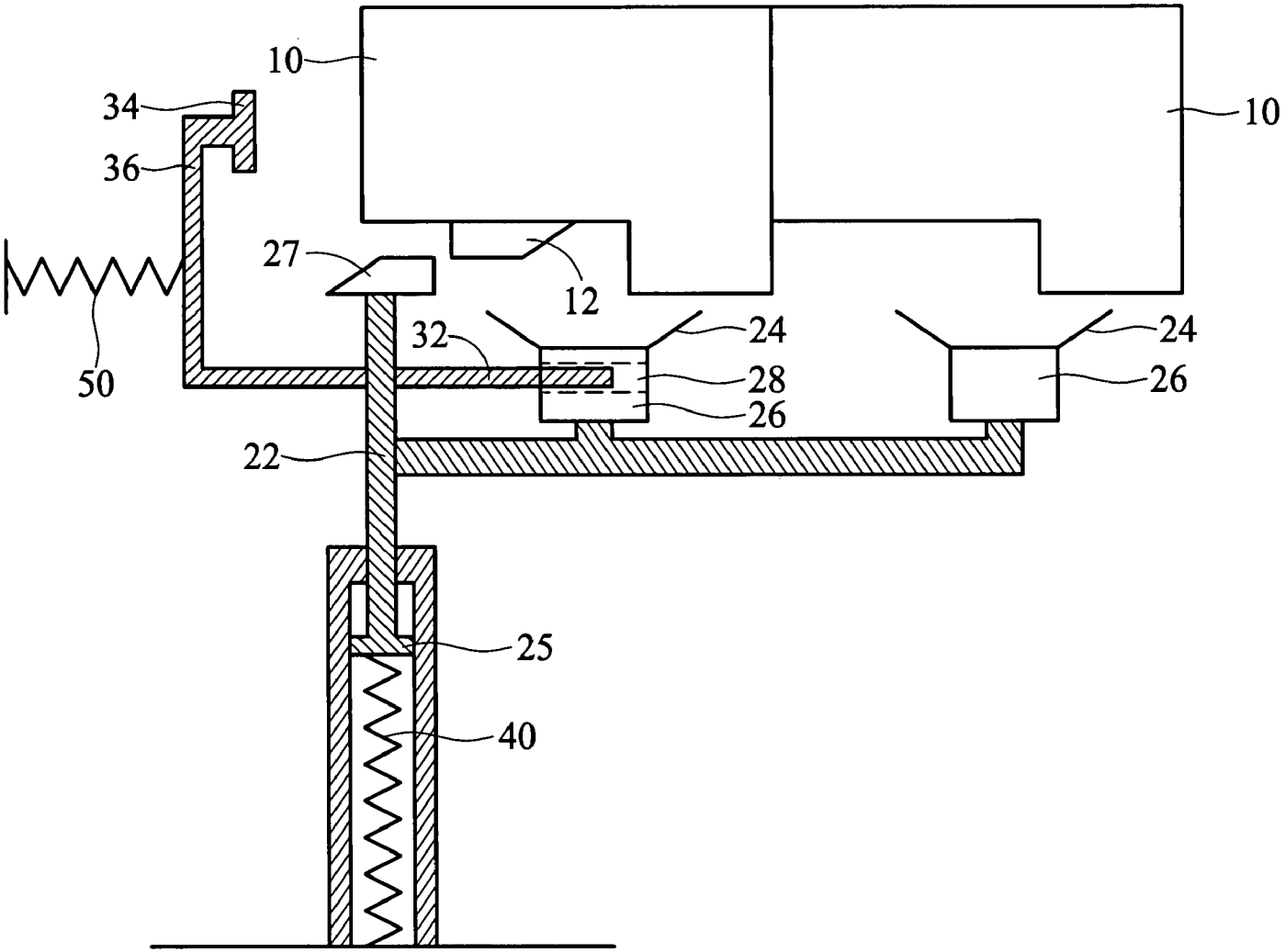
FIG. 10 is schematic view of a printer with a plurality of print head of the invention.

FIG. 10 depicts another embodiment of the printer comprising a plurality of print heads 10, a cap module 20, a positioning module 30, a first bias member 40 and a second bias member 50. The first guide member 12 is disposed on one of the print heads, which is adjacent to the positioning module 30. The cap module 20 comprises a plurality of caps 24 and cap seats 26 corresponding to the print heads 10. The hole 28 is formed on one of the cap seats 26. In this embodiment, the hole 28 is formed on the cap seat 26 adjacent to the positioning module 20.

Figure 11B:
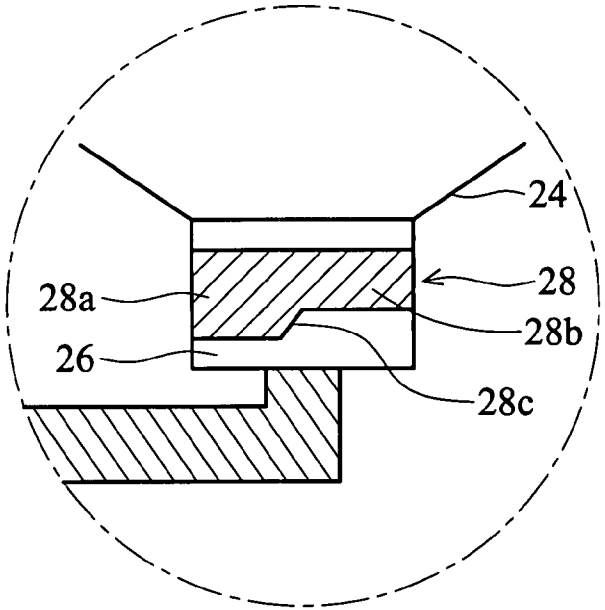
FIGS. 11A and 11B depict another embodiment of the hole of the invention.
Figure 11A:
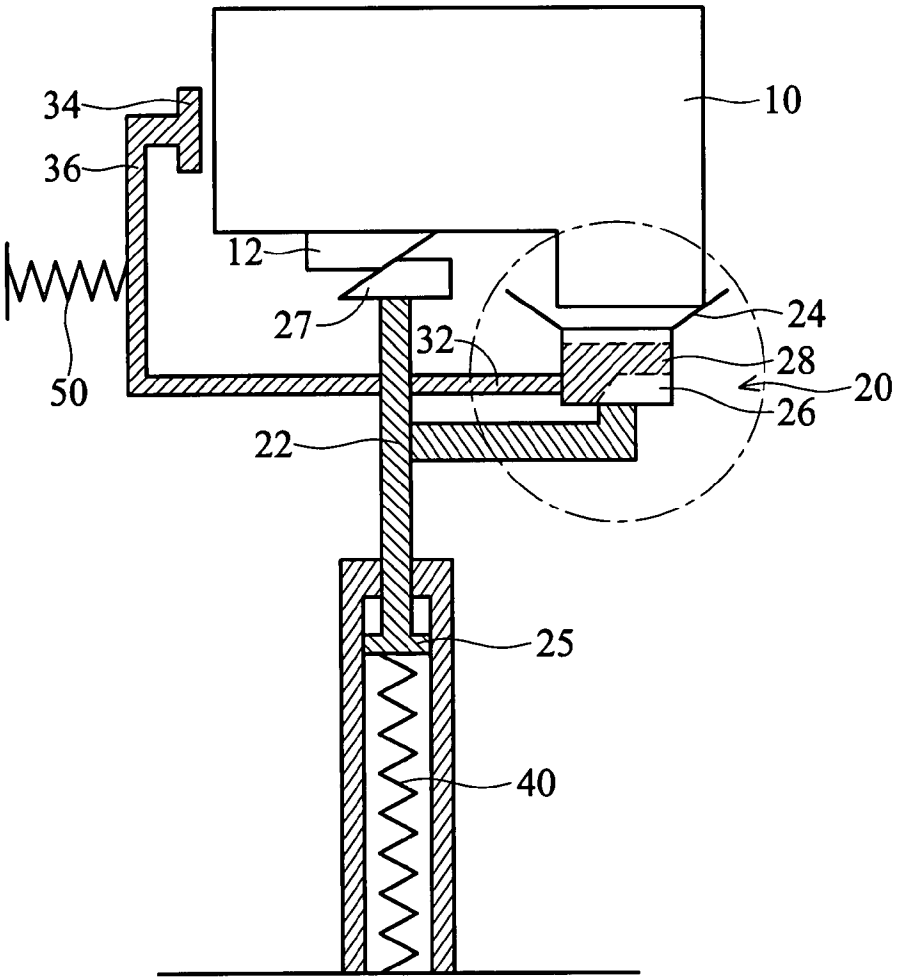

FIGS. 11A and 11B depict another embodiment of the hole 28 comprising a first portion 28*a* and a second portion 28*b*. The diameter of the first portion 28*a* is larger than that of the second portion 28*b*. An incline 28*c* is formed between the first and second portions 28*a* and 28*b*. When the pin 32 escape from the hole 28, the positioning module 20 rises gradually to prevent the cap 24 from suddenly impacting the print head 10. The incline 28*c* reduces friction between the pin 32 and the inner surface of the hole 28 when the pin 32 travels through the first portion 28*a* to the second portion 28*b* or vice versa.

The cap 24 is moved after the print head 101 has moved to a predetermined position, whereby the cap 24 does not interfere with the print head 10 during contact process, causing superior sealing effect and long service life.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A printer, comprising:

a print head comprising a nozzle;

a cap module comprising a cap and a hole; and a positioning module comprising a pin, wherein when the print head moves in a first direction to push the positioning module, the pin escapes from the hole, whereby the cap module moves in a second direction enabling the cap to cover the nozzle, and when the print head moves in a direction opposite to the first direction, the pin enters the hole enabling the cap module to maintain a predetermined distance with the print head.

2. The printer as claimed in claim 1, wherein the print head further comprises a first guide member, and the cap module further comprises a second guide member, when the print head moves in the direction opposite to the first direction, the first guide member pushes the second guide member, thereby the pin enters the hole.

3. The printer as claimed in claim 2, wherein the first guide member has a first incline, and the second guide member has a second incline contacting the first incline when the first guide member pushes the second guide member.

4. The printer as claimed in claim 1 further comprising a first bias member biasing the cap module to move the cap module toward the print head and cover the nozzle, wherein the print head moves in the direction opposite to the first direction and pushes the cap module to resist the bias force of the first bias member.

5. The printer as claimed in claim 1 further comprising a second bias member biasing the positioning module, wherein when the print head moves in the direction opposite to the first direction, the second bias member biases the positioning module, whereby the pin enters the hole.

6. The printer as claimed in claim 1, wherein the pin comprises an end surface with fillets.

7. The printer as claimed in claim 1, wherein the hole comprises a first portion and a second portion having a diameter smaller than that of the first portion, and the pin, entering the hole, passes through the first portion and the second portion sequentially.

8. The printer as claimed in claim 7, wherein the hole further comprises an incline disposed between the first and second portions.

9. The printer as claimed in claim 1, wherein the first direction is substantially perpendicular to the second direction.

10. A printer, comprising:

a plurality of print heads comprising nozzles respectively;

a cap module comprising a plurality of caps corresponding to the print heads and a hole;

a positioning module comprising a pin, wherein when the print heads move in a first direction to push the positioning module, the pin escapes from the hole, whereby the cap module moves in a second direction enabling the caps to cover the nozzles, and when the print heads move in a direction opposite to the first direction, the pin enters the hole enabling the cap module to maintain a predetermined distance from the print heads.

11. The printer as claimed in claim 10, wherein one of the plurality of print heads is adjacent to the positioning module, said print head further comprises a first guide member, and the cap module further comprises a second guide member, so that, when the print heads move in the direction opposite to the first direction, the first guide member pushes the second guide member, whereby the pin enters the hole.

12. The printer as claimed in claim 10, wherein the first direction is substantially perpendicular to the second direction.

* * * * *